United States Patent [19]

Hasegawa

[11] Patent Number: 5,039,240

[45] Date of Patent: Aug. 13, 1991

[54] PRINTING DEVICE WITH RIBBON CASSETTE SHIFTING MECHANISM

[75] Inventor: Yuzo Hasegawa, Kariya, Japan

[73] Assignee: Brother Kogyo Kabushiki Kaisha, Tokyo, Japan

[21] Appl. No.: 325,663

[22] Filed: Mar. 20, 1989

[30] Foreign Application Priority Data

Mar. 23, 1988 [JP] Japan ..... 63-69135

[51] Int. Cl.[5] ..... B41J 35/10

[52] U.S. Cl. ..... 400/212; 400/216

[58] Field of Search ..... 400/212, 216, 216.1, 400/216.2, 217, 208

[56] References Cited

U.S. PATENT DOCUMENTS 4,614,448 9/1986 Suzaki et al. ..... 400/208

FOREIGN PATENT DOCUMENTS 0186892 12/1985 European Pat. Off. ..... 400/212

0221836 7/1986 European Pat. Off. ..... 400/212

*Primary Examiner*—David A. Wiecking

*Attorney, Agent, or Firm*—Kane, Dalsimer, Sullivan, Kurucz, Levy, Eisele and Richard

[57] ABSTRACT

In a printing device, a stationary element and a contact element for detecting an original position are respectively provided on a frame and on a gear pivotally rotating through a stepping motor. By employing an above arrangement, it is possible to easier assemble and adjust for a uniform printing quality, which is guaranteed even with a smaller size of the stepping motor.

4 Claims, 2 Drawing Sheets

PRINTING DEVICE WITH RIBBON CASSETTE SHIFTING MECHANISM

BACKGROUND OF THE INVENTION

There has been a known printing device with a print ribbon pivotally movable between a rest position and a print position. As shown in FIG. 1, for instance, a ribbon cassette holder 2 having a print ribbon cassette 1 mounted thereon is pivotally carried on a carriage frame 4 by means of a support shaft 6. The frame 4 is supported on a guide shaft 8 fixedly secured to a chassis (not shown) to be movable axially on the shaft 8 in a direction parallel to a platen 3. There is a stepping motor 10 movable forward and reverse mounted on the frame 4, whose rotary shaft bears a pinion gear 12 with the number of teeth of Z1 splined to the shaft. In mesh with the pinion gear 12 is a larger gear 14 whose number of teeth is Z2. Gear 14 is carried by the frame 4 to be rotatable forward and in reverse. The larger gear 14 has integrally mounted thereon a smaller gear 16 whose number of teeth is Z3. In mesh with the smaller gear 16 is a toothed sector element 18 which is secured to the ribbon cassette holder 2 and whose number of teeth is Z4. The number of teeth Z2 of the larger gear 14 is greater than the number of teeth Z1 of the pinion gear 12, and the number of teeth Z4 of the toothed element 18 is greater than the number of the teeth Z3 of the smaller gear 16. A reduction gearing 20 consists of the pinion gear 12, the larger gear 14, the smaller gear 16 and the toothed element 18.

There is a contact element 22 provided under the ribbon cassette holder 2. On the frame 4 a stationary element 24 is formed opposed to the contact element 22. The stationary element 24 is brought into contact with the contact element 22 when the ribbon cassette holder 2 is pivotally swung in the direction indicated by the arrow A in FIG. 1.

In such a printing device, a predetermined number of drive pulses are given to the stepping motor 10 when the power is turned on. As a result, the stepping motor 10 is turned in the direction indicated by the arrow A to swing the ribbon cassette holder 2 in the direction indicated by the arrow A via the reduction gearing 20. The contact element 22 is thus brought into contact with the stationary element 24 to once bring the stepping motor 10 out of pace. A particular excitation phase of the stepping motor 10 is then excited. The stepping motor 10 is then rotated in the direction opposite to the arrow A by such excitation of a particular excitation phase until it stops at a stabilized position given by excitation of the particular excitation phase. The stop position of the motor is now assumed to be the original position, with reference to which all the subsequent controls take place. Therefore, a certain clearance C1 will be generated between the contact element 22 and the stationary element 24.

When printing, a given number of drive pulses are fed to the stepping motor 10 to turn it in the direction opposite to the arrow A. Accordingly, the ribbon cassette holder 2 is swung to position ribbon 1*a* to the print position indicated by a double-dot-dash line in FIG. 1, thereby enabling printing.

However, such a conventional printing device has been associated with a problem in that if the stepping motor 10 is made smaller or the reduction gearing 20 should provide a greater gear ratio, the original position being detected is displaced by an angle corresponding to an angle $\theta$ of the certain excitation phase of the stepping motor 10.

In particular, a nominal design value of the clearance C1 when detecting the original position is calculated by the following equation and is usually a small value on the order of 0.1 or 0.2 mm.

$$C1=\theta\times(Z1/Z2)\times(Z3/Z4)\times L1\times K \quad (1)$$

where $\theta$ is the angle of the exciting phase of the stepping motor 10, L1 is a distance between the center of the support shaft 6 and the contact element 22, and K is a predetermined safety factor constant.

When the contact element 22 is brought into contact with the stationary element 24, for instance, in detecting the original position, the amount of rebound may be larger than the clearance C1. This results in that the original position of the stepping motor 10 may be displaced through the angle $\theta$ of the excitation phase, whereby the print position is also displaced through an angle corresponding to the angle $\theta$ of the excitation phase. To avoid this, it has been necessary to design the assembly to maintain the rebound within the clearance C1. This however contradicts the requirement to make the stepping motor 10 smaller and to provide a greater reduction gear ratio of the reduction gearing because the clearance C1 would then be reduced to an undesirable value, resulting in difficulties in assembly and adjustment and therefore in a non-uniform printing quality.

SUMMARY OF THE INVENTION

It is therefore an object of the present invention to provide an improved printing device capable of being more easily assembled and adjusted for uniform printing quality while making the stepping motor smaller and the reduction gear ratio of the reduction gearing greater.

For this purpose, according to this invention, there is provided a printing device comprising a ribbon holder mounted on a frame of a carriage and being movable along a platen. The ribbon holder holds a print ribbon and is capable of being shifted between its print position and its rest position. Transmit means are provided rotatably supported by the frame for transmitting drive power to a threaded portion provided on a predetermined position of the ribbon holder. Drive means are provided for shifting the ribbon holder through said transmit means. The printing device further comprises: a stationary element provided on a predetermined position of the frame; a contact element provided on a predetermined position of the transmit means; and control means for controlling the drive means so as to place the ribbon holder at a position corresponding to a predetermined original position in case the stationary element and the contact element are brought into contact with each other.

DESCRIPTION OF THE ACCOMPANYING DRAWINGS

FIG. 1 is a schematic structural view showing a conventional printing device; and FIG. 2 is a schematic structural view showing a printing device according to the present invention.

DESCRIPTION OF THE EMBODIMENT

Figure 1:
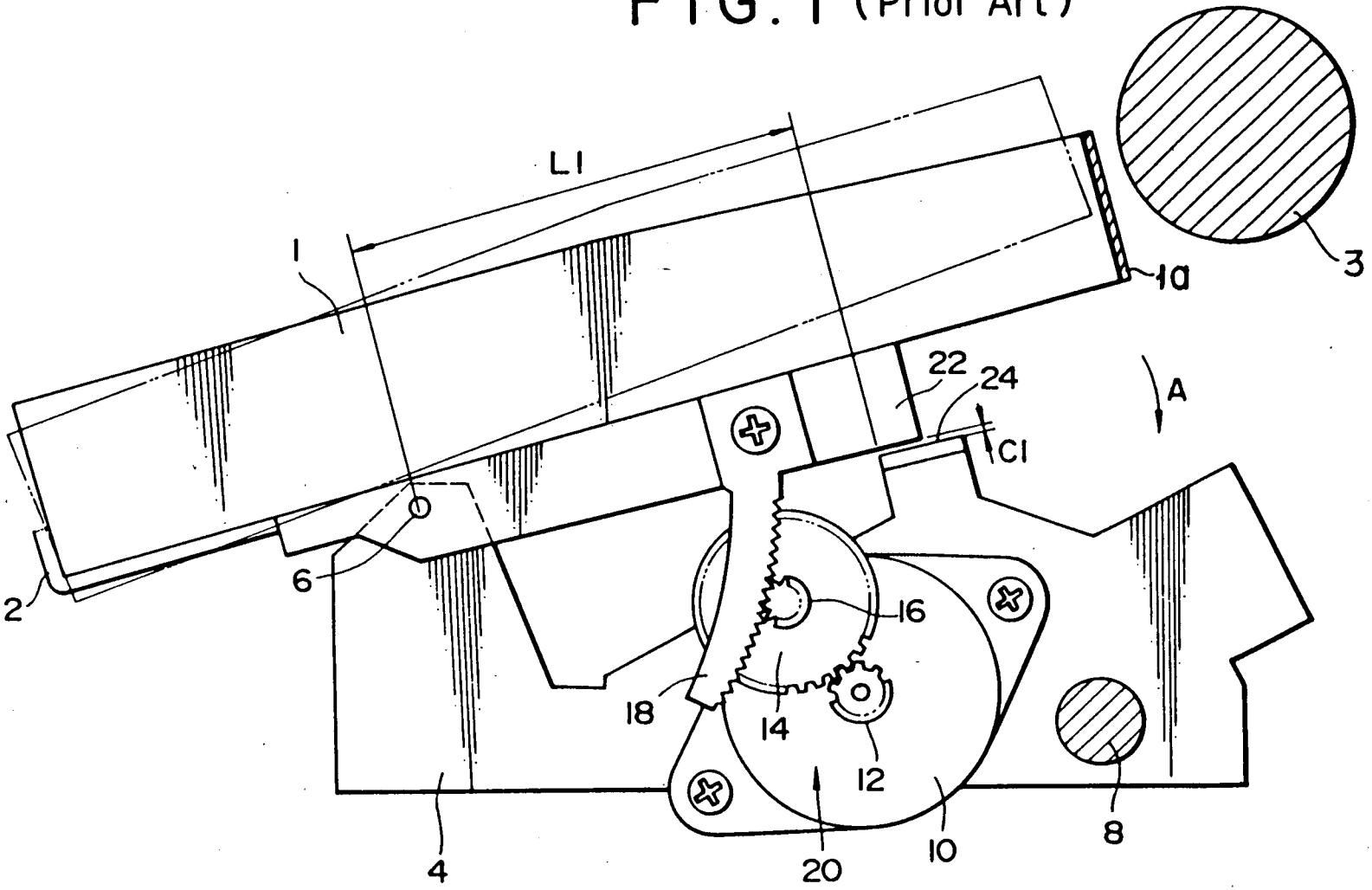
FIG. 1 (Prior Art)
Figure 2:
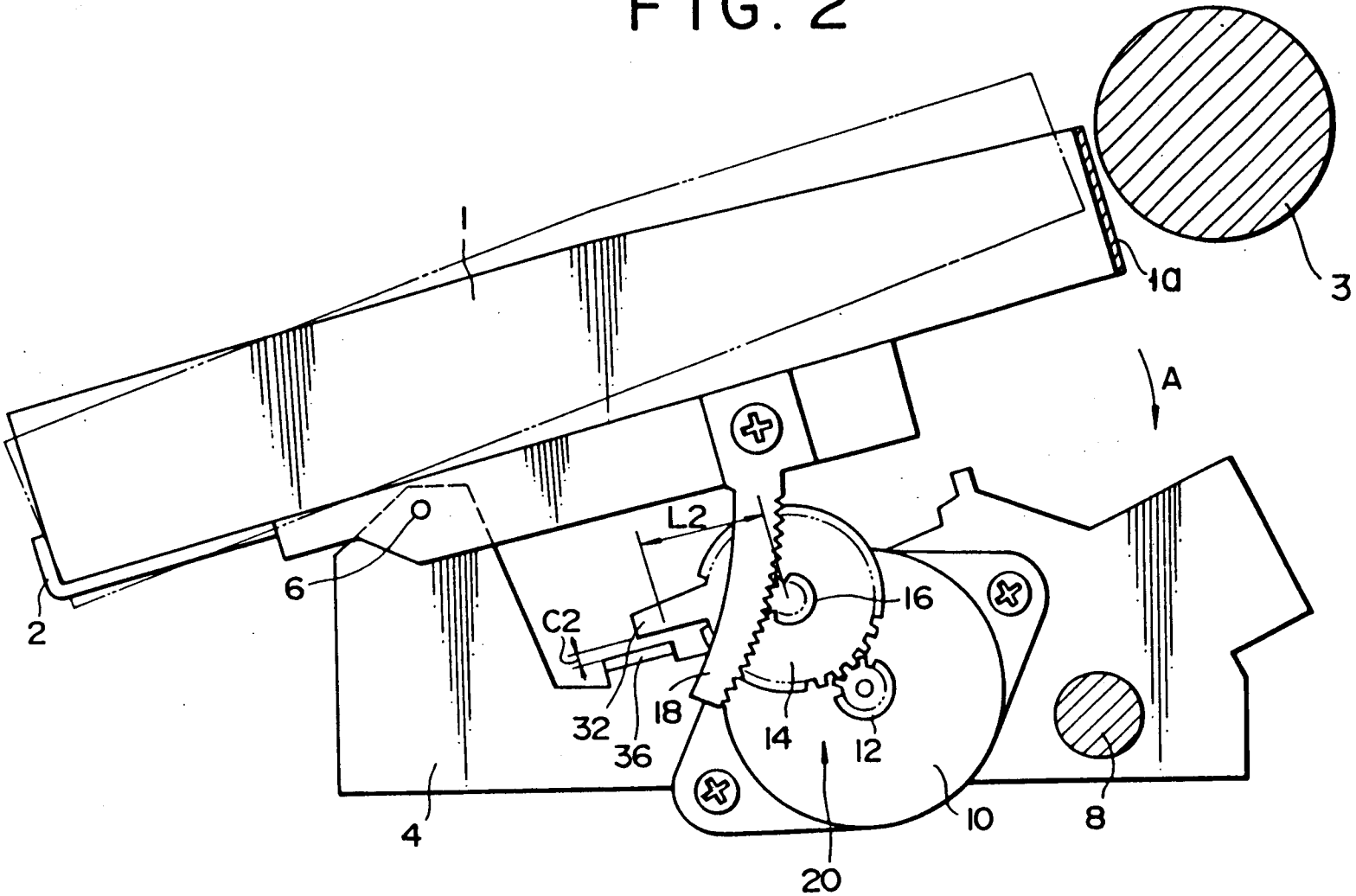

FIG. 2 is a schematic structural view of a printing device embodying the invention. Like reference numerals indicate like and similar parts in the prior art printing device shown in FIG. 1, whose detailed description is omitted here.

As shown in FIG. 2, a stepping motor 10 has a pinion gear 12 with a number of teeth Z1 splined to its rotary shaft. In mesh with the pinion gear 12 is a larger gear 14 with a number of teeth Z2, carried by the carriage frame 4 to be rotatable forward and in reverse. The larger gear 14 is provided with a radially extending contact element 32. The larger gear 14 also has a smaller gear integrally rotatable therewith, whose number of teeth is Z3. The smaller gear is in mesh with a toothed sector element 18 fixedly secured to the underside of the ribbon cassette holder 2, whose number of teeth is Z4. The pinion gear 12, larger gear 14, smaller gear 16 and toothed sector element 18 together constitute a reduction gearing 20, while the larger gear 14 and the smaller gear 16 form a drive transmitting unit.

There is a stationary element 36 generated on the position at which the contact element 32 on the frame 4 is brought into contact with the stationary element 36 when the larger gear 14 is rotated in the direction indicated by the arrow A in FIG. 2.

Explanation is now made for the operation of the arrangement according to this embodiment as described above.

When the power is turned on, a predetermined number of pulses for a given number of steps which is enough to bring the contact element 32 into contact with the stationary element 36 are fed to the stepping motor 10 to turn it in the direction indicated by the arrow A. This causes the larger gear 14 in mesh with the pinion gear 12 to rotate in the direction opposite to the arrow A, while at the same time, the toothed element 18 in mesh with the smaller gear 16 is rotated in the direction of arrow A. Ribbon cassette holder 2 is likewise moved angularly about the support shaft 6 in the direction indicated by the arrow A. Rotation of the larger gear 14 also causes the contact element 32 to rotate in the same direction to be brought into contact with the stationary element 36.

When the contact element 32 is brough into contact with the stationary element 36, the stepping motor 10 comes out of pace. A particular excitation phase of the stepping motor 10 is then excited after completing input of pulses for a certain number of steps. The stepping motor 10 is thus rotated in the direction opposite to the arrow A to a stabilized position given by exciting this excitation phase and is maintained in the position by means of a static torque. This is the original position indicated by a solid line in FIG. 2. This is used as a rest position in the present embodiment.

In this original position, there will be a predetermined clearance C2 between the contact element 32 and and the stationary element 36. The design value of the clearance C2 is calculated by the following equation.

$$C2=\theta\times(Z1/Z2)\times L2\times K \qquad (2)$$

where L2 is a distance between the center of the larger gear 14 and the contact element 32, $\theta$ is an angle of the excitation phase of the stepping motor 10 as stated before, and K is a safety factor constant taking a similar rebound as stated before into consideration.

The ratio of the clearance C1 to the the clearance C2 is thus obtained from equations (1) and (2).

$$C2/C1=(L2/L1)\times(Z4/Z3) \qquad (3)$$

While the ratio L2/L1 in length is on the order of only several fractions, the tooth ratio Z4/Z3 is an extremely large value ranging from teens to tens. The ratio of the clearances C2 to C1 will therefore be teens to tens, so that a considerably large value can be selected for the clearance C2. This facilitates assembly and adjustment of the printing device with no need for extreme precision in manufacturing parts, resulting in a uniform printing quality. If the clearance C2 is given about the same value as that of the clearance C1, the tooth ratio Z4/Z3 can be increased accordingly. As a result, with a more compact stepping motor 10 and a greater gear ratio of the reduction gearing 20, there will be no displacement of the print position due to rebound, ensuring a uniform printing quality.

When, on the other hand, pulses for a certain number of steps are given to the stepping motor 10 after detecting the original position to rotate it in the direction opposite to the arrow A, the ribbon cassette holder 2 is swung together with the print ribbon cassette 1 in the direction opposite to the arrow A so as to move from the rest position to the print position indicated by the double-dot-dash line in FIG. 2. Then, a printing operation is executed by means of a print head not shown by way of the print ribbon.

As has been described above, in the printing device according to this embodiment, detection of the original position is carried out in a manner that the stepping motor 10 is rotated to angularly move the ribbon cassette holder 2 via the reduction gearing 20 until the contact element 32 integrally formed on the larger gear 14 is brought into contact with the stationary element 36. After detecting the original position, the print ribbon is swung in the opposite direction to move between the rest position and the print position.

Since the printing device according to this embodiment allows the clearance C2 to be substantially greater than the existing clearance C1, it is easier in assembly and adjustment, thereby providing a uniform printing quality. Also, the stepping motor 10 can be made more compact without reducing the clearance, again ensuring a uniform printing quality.

While a preferred embodiment of the invention has been fully described above, it would be readily understood that the present invention is not limited to this embodiment but can be embodied with different changes and modifications without departing from the subject matter of the present invention.

What is claimed is:

1. A printing device comprising a ribbon holder mounted on a frame of a carriage being movable along a platen, said ribbon holder holding a cassette containing a print ribbon and being capable of being shifted between its print position and its rest position, transmit means rotatably supported by said frame for transmitting drive power to a toothed portion provided on a predetermined position of said ribbon holder, drive means for shifting said ribbon holder through said transmit means, said printing device further comprises:

a stationary element provided on a predetermined position of said frame;

a contact element provided on a predetermined position of said transmit means; and control means for controlling said drive means so as to place said ribbon holder at a position corresponding to a predetermined original position if said stationary element and said contact element are brought into contact with each other.

2. The printing device according to claim 1 wherein said transmit means comprises a gear having a predetermined number of teeth and another gear being integrally rotatable with said gear and having another predetermined number of teeth which is less than said predetermined number of teeth, said another gear being arranged to be brought into engagement with said toothed portion on said ribbon holder, and said contact element being provided on said gear.

3. The printing device according to claim 1 wherein said drive means comprises a stepping motor being rotatable forward and reverse.

4. The printing device according to claim 1 wherein said control means further controls said drive means so as to place said ribbon holder at said rest position after said ribbon holder is placed at said position corresponding to said predetermined original position.

* * * * *